US006626373B1

(12) United States Patent
Ruehle et al.

(10) Patent No.: US 6,626,373 B1
(45) Date of Patent: Sep. 30, 2003

(54) FUEL INJECTION VALVE

(75) Inventors: Wolfgang Ruehle, Ditzingen (DE); Hubert Stier, Asperg (DE); Matthias Boee, Ludwigsburg (DE); Guenther Hohl, Stuttgart (DE); Norbert Keim, Loechgau (DE)

(73) Assignee: Robert Bosch GmbH, Stuttgart (DE)

( * ) Notice: Subject to any disclaimer, the term of this patent is extended or adjusted under 35 U.S.C. 154(b) by 181 days.

(21) Appl. No.: 09/856,993

(22) PCT Filed: Sep. 28, 2000

(86) PCT No.: PCT/DE00/03423

§ 371 (c)(1),
(2), (4) Date: Aug. 28, 2001

(87) PCT Pub. No.: WO01/23748

PCT Pub. Date: Apr. 5, 2001

(30) Foreign Application Priority Data

Sep. 30, 1999 (DE) ..... 199 46 869

(51) Int. Cl.[7] ..... B05B 1/08

(52) U.S. Cl. ..... 239/102.1; 239/585.1; 239/585.5; 239/533.2; 239/533.9

(58) Field of Search ..... 239/585.1, 585.4, 239/585.5, 533.2, 533.3, 533.9, 102.1, 102.2, 89, 90, 91; 251/129.15, 129.21, 127

(56) References Cited

U.S. PATENT DOCUMENTS

| | | | | |
|---|---|---|---|---|
| 4,101,076 A | * | 7/1978 | Bart | 239/584 |
| 4,550,744 A | | 11/1985 | Igashira et al. | |
| 6,085,990 A | * | 7/2000 | Augustin | 239/88 |
| 6,435,430 B1 | * | 8/2002 | Ruehle et al. | 239/585.4 |
| 6,502,803 B1 | * | 1/2003 | Mattes | 251/129.06 |
| 6,517,014 B1 | * | 2/2003 | Ruehle et al. | 239/585.1 |

FOREIGN PATENT DOCUMENTS

| | | |
|---|---|---|
| DE | 196 53 555 | 6/1998 |
| DE | 197 44 235 | 4/1999 |
| DE | 198 07 903 | 9/1999 |
| EP | 0 477 400 | 6/1929 |
| EP | 0 869 278 | 10/1998 |

* cited by examiner

*Primary Examiner*—Davis Hwu
(74) *Attorney, Agent, or Firm*—Kenyon & Kenyon

(57) ABSTRACT

A fuel injector, especially an injector valve for fuel injection equipment in internal combustion engines, includes a piezoelectric or magnetostrictive actuator and a valve closing body, operable by an actuator with the aid of a valve needle, which cooperates with a valve seat surface to form a sealing seat, and a valve housing. The actuator is prestressed by a compression spring and, together with this, is surrounded by an actuator housing which is supported by fluid at both its ends.

11 Claims, 1 Drawing Sheet

FUEL INJECTION VALVE

FIELD OF THE INVENTION

The present invention relates to a fuel injector.

BACKGROUND INFORMATION

Ordinarily, changes in length of a piezoelectric actuator in a fuel injector are compensated for by the influence of temperature using hydraulic devices or by choosing suitable material combinations.

European Published Patent Application No. 0 869 278 describes a fuel injector in which the longitudinal change of the actuator is compensated for by an appropriate material combination. The fuel injector as in this document has an actuator, positioned in an actuator chamber, which is connected with form locking to a pressure shoulder via which the actuator acts upon the valve needle in opposition to the force of a pressure spring. The actuator is supported at one end on a pressure plate, and at the other end on a control element. During operation of the actuator, the valve needle is activated in the direction of spray-off.

In the document named, compensation for the longitudinal change of the actuator, caused by temperature, is achieved by a plurality of compensation discs positioned between the pressure plate and the end face of the actuator. These have a temperature expansion coefficient corresponding with opposite sign to that of the actuator element. During a shortening of the actuator caused by rising temperature, the compensation discs expand, and thereby compensate for the thermal longitudinal change of the actuator.

This design has a disadvantage above all in connection with cost of manufacture, having relatively high costs conditional especially on the choice of materials (e.g. INVAR). The compensation for longitudinal changes by hydraulic devices is known, for instance, from European Patent 0 477 400. With designs of this kind, the fundamental disadvantage is that large volumes of liquid have to be displaced, and, because of that, there is a greater tendency to cavitation.

SUMMARY OF THE INVENTION

The fuel injector according to the present invention on the other hand, has the advantage of simple construction of the component parts, from a standpoint of production engineering. This guarantees a fail-safe and precise method of operation of the fuel injector. Of particular advantage are the liquid support on both sides and the low damping volume for avoiding cavitational damage.

Especially of advantage are the encapsulation and prestressing of the actuator, since the quasi-static thermal linear deformation of the actuator does not have to be compensated for by costly material combinations, but is compensated for by a change in initial stress of the compression spring. Thereby, the overall length of the actuator housing is not influenced by thermal changes in length. For that reason, only a change in position of the actuator housing relatively to the valve housing still has to be compensated.

Sealing the actuator housing from the valve housing has the advantage that the actuator cannot be attacked by the chemically aggressive fuel.

The use of fuel as hydraulic medium is of advantage, since leakage losses can be compensated permanently by fuel supply.

DETAILED DESCRIPTION

Figure 1:
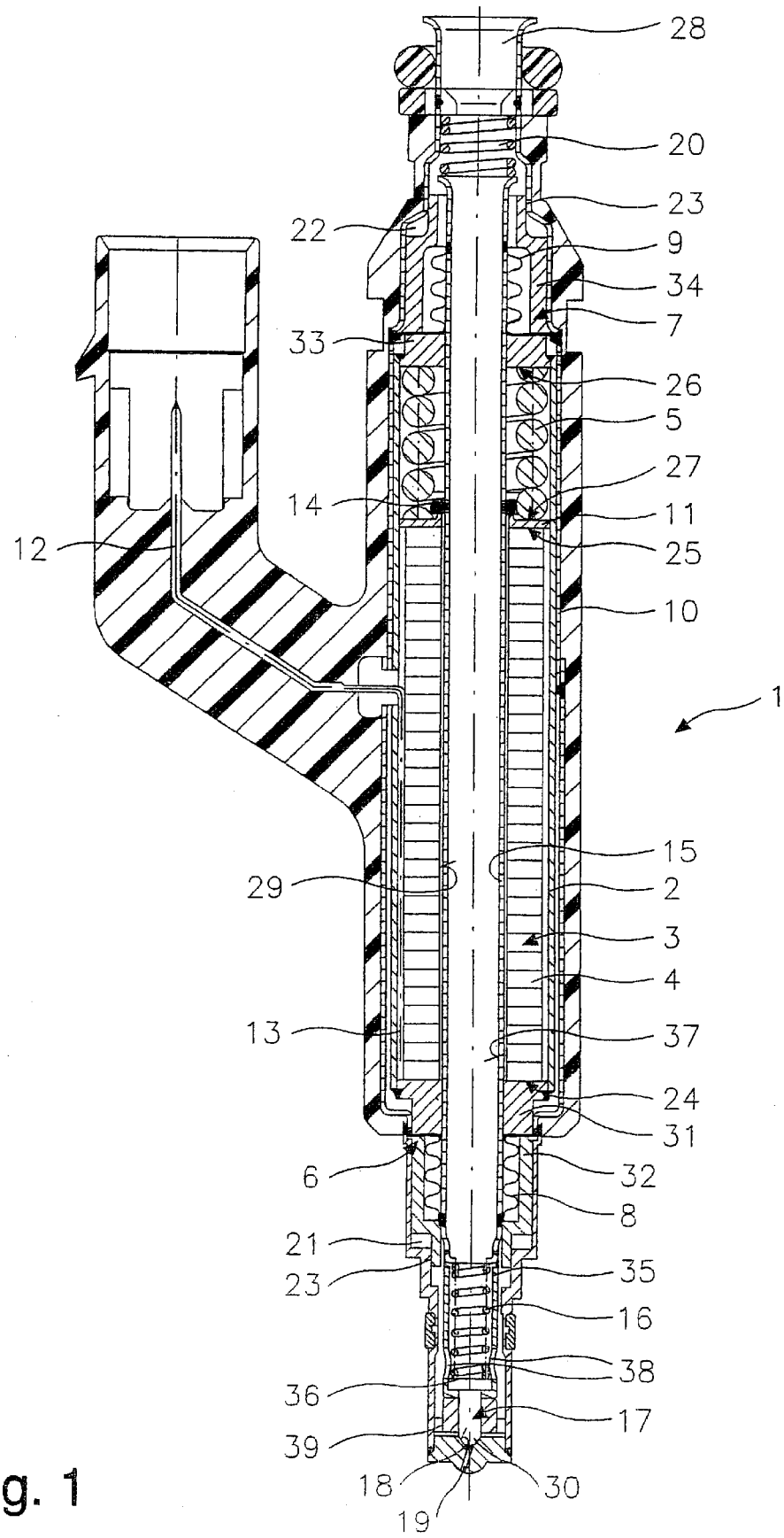
FIG. 1 shows an axial section through an exemplary embodiment of a fuel injector according to the present invention.

In an axial section, FIG. 1 illustrates an exemplary embodiment of fuel injector 1 according to the present invention. This is about a so-called top feed injection valve having central fuel supply via a fuel inlet 28 which opens toward the inside.

In an actuator housing 2, an actuator 3 of ring-shaped design, having a central hollow recess 29 and being made of disc-shaped piezoelectric or magnetostrictive elements 4 and a compression spring 5, are located. The actuator 3 is operated by an external voltage source via a plug connection 12. To make it simple, only one single contact 13 is shown in FIG. 1. The actuator housing is closed at its ends by a first outer flange 6 and a second outer flange 7, which are sealed from a valve housing 10 surrounding the actuator 3 by a first sealing element 8 and a second sealing element 9.

The first outer flange 6 includes a first disc 31 and a first sleeve 32. The first disc 31 lies at a first end face 24 of actuator 3. The second outer flange 7 includes a second disc 33 and a second sleeve 34. The second disc 33 abuts a first end 26 of compression spring 5. A second end face 25 of actuator 3 and a second end 27 of compression spring 5 are supported on a middle flange 11. Actuator 3 is held under prestress by compression spring 5 via middle flange 11.

Middle flange 11 is preferably connected with force-locking to an operating body 15 by a weld 14. The operating body 15 is located in the central recess 29 of actuator 3, and is in contact, via extension an 35, with a valve needle 17, at which a valve closing body 30 is formed. During lifting off of the valve closing body 30 from a valve seat surface 18 of a valve seat body, fuel is sprayed off through a spray-off opening 19. Operating body 15 is supported on the inlet side on a return spring 20 and grips from behind with its spray-off side extension 35 a flange 36 of valve needle 17. Between flange 36 of valve needle 17 and operating body 15 a spring 16 is clamped. During the closing movement, operating body 15 can swing through with respect to valve needle 17, so that only the inert mass of valve needle 17 strikes against valve seat surface 18. This avoids bounce pulses. The fuel flows through an inner hollow recess 37 of the operating body 15, transverse borings 38 upstream from flange 36 and at least one passage 39 to the sealing seat.

Between first sleeve 32 of first outer flange 6 and valve housing 10 there is a first damping chamber 21. Between the second sleeve 34 of second outer flange 7 and valve housing 10 there is a second ring-shaped damping chamber 22. Damping chambers 21 and 22 are in contact with fuel inlet 28 via guide slot 23 partially throttled, and are thereby filled with fuel as damping medium. They buffer actuator housing 2 against valve housing 10. When needed, damping medium is supplied or given off via guide slot 23. Actuating housing 2 is thus axially freely, slidingly movable in valve housing 10, under oppositely changing volumes in first damper chamber 21 and second damper chamber 22.

When an electrical operating voltage is connected to actuator 3 of fuel injector 1 according to the present invention shown in FIG. 1, the disc-shaped elements 4 of actuator 3 expand, whereby middle flange 11 is moved counter to the flowing direction of the fuel. Compression spring 5 is further pressed together, counter to the already present prestressing. Valve closing body 30 lifts off valve seat surface 18 and fuel is sprayed off through spray-off opening 19.

Because of the great operating frequency of actuator 3 during the operation of fuel injector 1 according to the present invention in an internal combustion engine, the damping medium between the outer flanges 6 and 7 of actuator housing 2 and valve housing 10 in damping chambers 21 and 22 behaves as an incompressible fluid, since the expansion of actuator 3 during its operation occurs too rapidly for the damping medium to escape through guide slot 23.

A fuel injector 1 experiences great temperature fluctuations during operation. On the one hand, the entire fuel injector 1 heats up through contact with the combustion chamber of an internal combustion engine, and on the other hand, local temperature effects appear, for instance, from the power loss during deformation of piezoelectric actuator 3 or from electrical charge movement. This results in a thermal length reduction of disc-shaped elements 4, since piezoelectric ceramics have negative temperature expansion coefficients, that is, they contract while heating up and expand while cooling.

Such a shortening of actuator 3 by heating is compensated inside actuator housing 2 by the expansion of prestressed compression spring 5. The shortening of actuator 2 leads to a lengthening of compression spring 5. Since middle flange 11 is stopped at operating body 15 by weld 14, the change of length of actuator 3 results in a positional change of actuator housing 2. This positional change of actuator housing 2 is opposed by the fluid storage of actuator housing 2 within valve housing 10, since, during quasi-static positional changes of actuator housing 2 relatively to valve housing 10 through temperature influences, the movement of actuator housing 2 takes place so slowly, that damper medium can escape through guide slot 23 or can continue flowing.

The present invention is not limited to the illustrated exemplary embodiment, but can also be carried out in a multitude of other methods of construction of fuel injectors.

What is claimed is:

1. A fuel injector, comprising:

one of a piezoelectric actuator and a magnetostrictive actuator;

a valve needle;

a valve seat surface;

a valve closing body that is operable by the one of the piezoelectric actuator and the magnetostrictive actuator with the aid of the valve needle, the valve closing body cooperating with the valve seat surface to form a sealing seat;

a compression spring for prestressing the one of the piezoelectric actuator and the magnetostrictive actuator; and an actuator housing supported at both ends thereof by a fluid and for surrounding the compression spring and the one of the piezoelectric actuator and the magnetostrictive actuator.

2. The fuel injector according to claim 1, wherein:

the fuel injector is an injection valve for fuel injection equipment in an internal combustion engine.

3. The fuel injector according to claim 1, further comprising:

a valve housing;

a first sealing element for sealing a first outer flange located at an end of the actuator housing from the valve housing; and a second sealing element for sealing a second outer flange located at another end of the actuator housing from the valve housing.

4. The fuel injector according to claim 3, wherein:

the first outer flange abuts a first end face of the one of the piezoelectric actuator and the magnetostrictive actuator, the second outer flange abuts a first end of the compression spring, and a second end face of the one of the piezoelectric actuator and the magnetostrictive actuator and a second end of the compression spring are supported on a middle flange.

5. The fuel injector according to claim 4, further comprising:

an operating body that is in touch with the valve needle and is firmly connected to the middle flange.

6. The fuel injector according to claim 4, wherein:

the actuator housing with the first outer flange borders on a ring-shaped first damping chamber filled with a damping medium, and the actuator housing with the second outer flange borders on a ring-shaped second damping chamber filled with the damping medium.

7. The fuel injector according to claim 6, further comprising:

a fuel inlet; and a guide slot, wherein:

the first damping chamber and the second damping chamber are in contact with the fuel inlet via the guide slot partially throttled.

8. The fuel injector according to claim 7, wherein:

a quasi-static positional change of the actuator housing mediated by the middle flange and caused by a thermal change of a length of the one of the piezoelectric actuator and the magnetostrictive actuator is offset by volume compensation in the first damping chamber and the second damping chamber in that the damping medium one of flows in and escapes via the guide slot.

9. The fuel injector according to claim 6, wherein:

the actuator housing is axially freely, slidingly movable subject to oppositely changing volumes of the first damping chamber and the second damping chamber.

10. The fuel injector according to claim 6, wherein:

the damping medium is a fuel flowing through the fuel injector.

11. The fuel injector according to claim 1, further comprising:

an operating body, wherein:

the one of the piezoelectric actuator and the magnetostrictive actuator is formed ring-shaped and includes a central recess in which the operating body acts upon the valve needle.

* * * * *